United States Patent [19]

Nickly

[11] 3,949,724

[45] Apr. 13, 1976

[54] CYLINDER HEAD UNITS FOR INTERNAL COMBUSTION ENGINES

[76] Inventor: Jean Nickly, 2 rue Le Royer, Lyon 3° (Rhone), France

[22] Filed: Mar. 27, 1972

[21] Appl. No.: 238,299

[30] Foreign Application Priority Data

Mar. 25, 1971 France ..... 71.11428

[52] U.S. Cl..... 123/193 H; 123/193 R; 123/188 M; 123/41.82 R

[51] Int. Cl.[2] ..... F01P 3/02; F02F 1/36

[58] Field of Search.....193 H, 193 CH, 41.82, 41.82 A, 123/193 R, 191 O, 191 M, 188 M

[56] References Cited

UNITED STATES PATENTS

| | | | |
|---|---|---|---|
| 2,561,674 | 7/1951 | Rhodes | 123/41.82 X |
| 2,710,602 | 6/1955 | Maybach | 123/41.82 X |
| 3,117,565 | 1/1964 | Botter et al. | 123/193 H |
| 3,159,148 | 12/1964 | Nallinger et al. | 123/188 M |

FOREIGN PATENTS OR APPLICATIONS

| | | | |
|---|---|---|---|
| 1,236,242 | 6/1971 | United Kingdom | 123/41.82 |
| 626,968 | 5/1936 | Germany | 123/193 CH |
| 2,017,877 | 4/1970 | Germany | 123/193 H |
| 525,256 | 5/1955 | Italy | 123/188 IM |
| 619,451 | 4/1961 | Italy | 123/188 IM |

*Primary Examiner*—Wendell E. Burns
*Attorney, Agent, or Firm*—Irving M. Weiner; Pamela S. Burt

[57] ABSTRACT

A unit cylinder head for an internal combustion engine, and preferably, a V-diesel engine, is provided with at least one vertical channel on each lateral side face thereof. The channel mates with a corresponding channel provided on adjacent cylinder head to define a receiving joint for a clamping screw which, thus, straddles two adjacent heads. The intake and exhaust valve seats of the head have the vertical plane joining the axes thereof inclined with respect to the vertical plane along the longitudinal axis of the engine. This permits the exhaust manifold to be short while the inlet manifold has a spiral profile. The lateral faces of the head are formed with openings through which moulding sand is, initially, removed and then are utilized for water circulation.

5 Claims, 5 Drawing Figures

CYLINDER HEAD UNITS FOR INTERNAL COMBUSTION ENGINES

The present invention provides improvements to cylinder heads for internal combustion engines, and particularly for diesel engines. It particularly concerns a unit cylinder head, that is to say of a type such that it allows of juxtapposing several identical cylinder heads on the block of, for example, a diesel engine.

The advantages of the unit cylinder head over a manifold head for a multi-cylinder engine are well known. In particular, it ensures a good seat on the cylinder head gasket, and simplifies the manufacture, since the same cylinder head may be mounted on engines of any number of cylinders.

On the other hand, the unit cylinder heads of known type lead to increased bulk of the engine and they necessitate the use of exterior water circulation piping to join all the cylinder heads by means of numerous unions.

The present invention has the aim of avoiding these disadvantages by the manufacture of a unit or single cylinder head with little or no loss of room and which, in a preferred form does not need the use of awkward and cumbersome exterior piping.

According to the invention a unit cylinder head for an internal combustion engine has provided on each lateral face of the head which is adapted to form the junction with another identical cylinder head, at least one vertical channel intended to match up with another channel in the adjacent cylinder head, to receive a clamping screw which thus straddles two cylinder heads.

According to a preferred feature of the invention, the clamping of the cylinder head is carried out by eight screws four of which each straddle two adjacent cylinder heads. Owing to the positioning of the fixing screws straddling two adjacent cylinder heads, there is greater liberty in locating the valves.

In consequence, an additional preferred feature of the invention consists of arranging the valve seatings in such a way that the vertical plane defined by the axes of their stems is inclined in relation to the vertical plane passing through the longitudinal axis of the engine, which allows the exhaust manifold to be shortened and the inlet manifold to be formed with a spiral profile.

Another preferred feature of the invention consists of providing on the lateral faces of the unit cylinder head some openings which successively are used for removing the moulding sand in the course of manufacture, then for the circulation of water from one cylinder head to another on the assembled engine, a sealing joint being compressed between the two adjacent cylinder heads.

An additional preferred feature of the invention concerns a cylinder head provided with an inlet valve and an exhaust valve controlled by rockers each operated by a stem which passes through the cylinder head, in which the inlet passage is situated between the stems of the rockers, this passage being prolonged by a spiral which ends at the inlet valve, whilst the exhaust channel opens on the opposite face of the cylinder head.

Such an arrangement is particularly advantageous if it is desired to fit the unit cylinder head to a V-engine. In fact, on a V-engine, the exhaust manifolds are with advantage situated on the exterior of the V, whilst it is possible to place the inlets and the single cam shaft within the V.

The invention will be better understood from the following description of certain embodiments, which are described here by way of example only with reference to the accompanying drawings, in which:-

Figure 1:
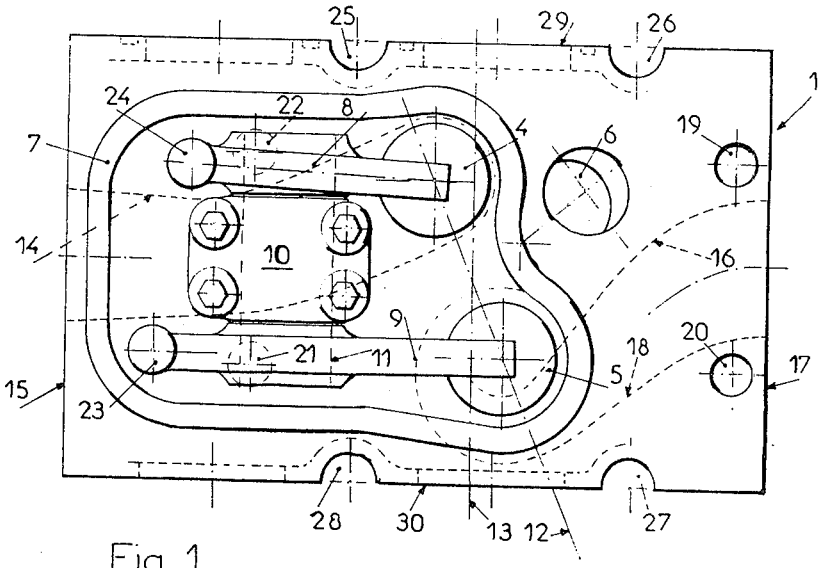
FIG. 1 is a plan view of a unit cylinder head.

There is shown on the drawings a unit cylinder head for a diesel engine which presents the following peculiarities:-

The body 2 of this cylinder head has a shape which is that of a rectangular parallelepiped and, on its lower face 3, that is to say on the face which when fitted, bears on the cylinder head gasket, there opens:-

- the seating of the exhaust valve 4;
- the seating of the inlet valve 5;
- a seating 6 intended to receive a fuel injector.

The body 2 is surmounted by a wall 7 which surrounds the valve seatings 4 and 5, the rockers 8 and 9 appertaining to the valves and a fixed support 10 on which is mounted the shaft 11 which is the common pivot shaft of the two rockers 8 and 9. The upper face of the wall 7 is intended to receive in the normal manner a cylinder head cover which is not shown.

The vertical plane 12 passing through the axes of the valve seatings 4 and 5 is inclined in relation to the vertical plane 13 which passes through the longitudinal axis of the engine. This arrangement has two advantages, namely:

- it allows the shortening of the exhaust manifold 14 which opens on the end face 15 of the cylinder head; in consequence, this reduces the heat loss in the cylinder head;
- the inlet manifold 16 which opens on the opposite end face 17, can thus have a direction favourable for the location of a spiral 18 portion of that manifold to set the air aspirated by the engine in rotation before the air penetrates into the chamber of the inlet valve 5.

It will be seen in FIG. 1 that, if the valves had not this arrangement, it would not be possible to locate the spiral 18 of the inlet manifold in a cylinder head of the same bulk.

The fixing of the unit cylinder head 1 is carried out by means of eight screws of which four are engaged in holes 19 and 20 near to the face 17 and in holes 21 and 22 located near the rocker stems 23, 24, whilst the other four are each arranged in a semi circular seat 25, 26, 27 or 28. The seats 25 and 26 are arranged on one of the lateral faces 29 of the body 2, whilst the seats 27 and 28 are placed on the opposite lateral face 30.

Figure 2:
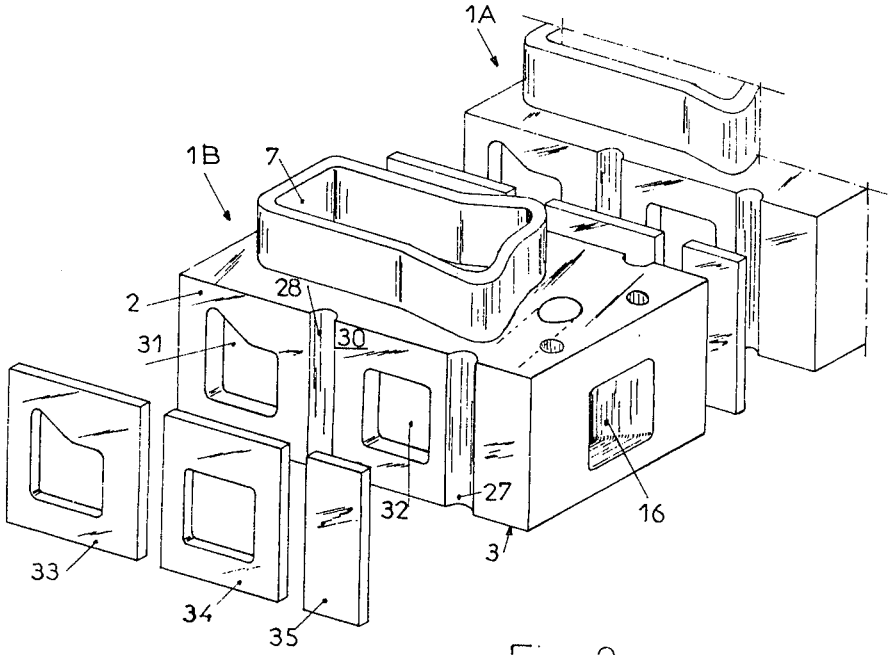
FIG. 2 is an exploded view of the cylinder head shown in FIG. 1, and the adjacent components.

Finally, large lateral openings such as 31 and 32 (see FIG. 2) are formed in the faces 29 and 30 between the seatings 25, 26, 27 or 28. These openings 31 and 32 are used for the removal of the moulding sand during the manufacture of the cylinder head. Later after several cylinder heads are fitted adjacent to each other such as 1A, 1B, 1C, 1D, these openings 31 and 32 provide the cooling water of the engine with a passage of large cross-sectional dimensions, which obviates the necessity for any exterior piping on the assembly (FIG. 2).

The fitting of the unit cylinder heads on the engine block is carried out by placing them side-by-side and by arranging between them rubber seals such as 33, 34, 35 themselves provided where necessary with an opening corresponding to the respective openings 31 and 32. It will be seen that each cylinder head 1A, 1B, 1C, 1D is fixed by eight screws of which four belong to it alone (screws 36, 37, 38, 39) whilst four others straddle two adjacent cylinder heads, namely:

- the screws 40 and 41 on two cylinder heads such as 1A and 1B:
- the screws 42 and 43 on two cylinder heads such as 1B and 1C.

Figure 3:
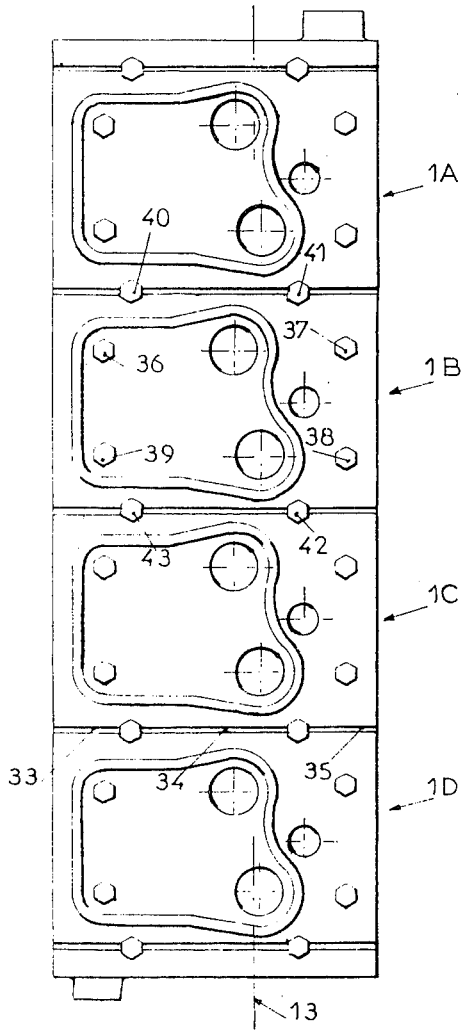
FIG. 3 is a plan view showing the assembly of four unit cylinder heads.

This method of fixing ensures a well distributed compression on the gasket of each cylinder head and saves space, that is to say it reduces the total length of the engine (FIG. 3) in relation to which would be necessary for the location of screws entirely located on each cylinder head.

Figure 4:
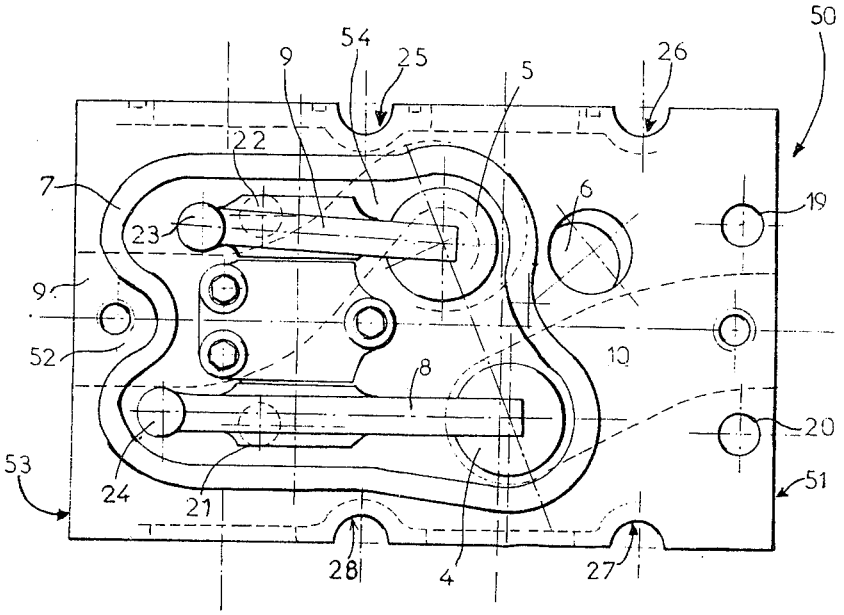
FIG. 4 is a plan view of an alternative unit cylinder head.
Figure 5:
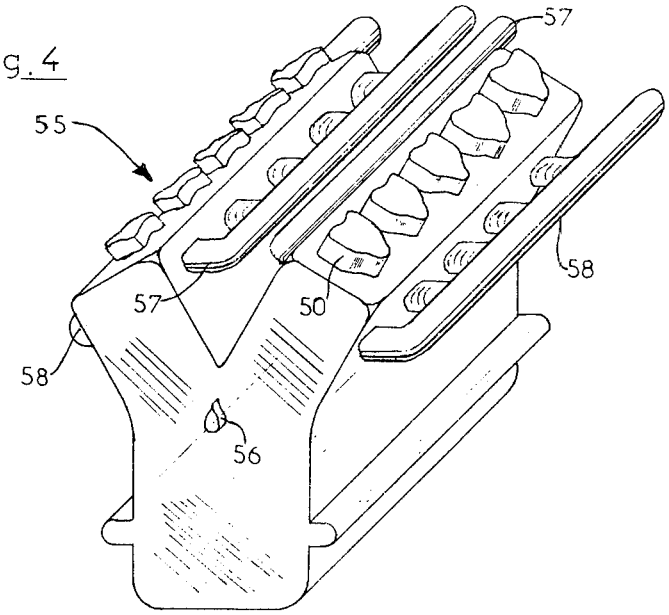
FIG. 5 is a V-engine fitted with unit cylinder heads.

In FIGS. 4 and 5, there is shown a variant in which the inlet manifold 9 of the unit cylinder head 50 is located between the two rocker stems 23 and 24, whilst the exhaust manifold 10 opens on the opposite face 51 of the cylinder head.

Finally, the inlet manifold 9 comprises an entry channel 52 which opens on the face 53 of the cylinder head; this channel 52 being prolonged by a turbulence spiral 54 which ends at the inlet valve seating 5. On the other hand, it will be noted that the exhaust manifold 10 is as short as possible.

This arrangement is of particular advantage when it is desired to fit unit cylinder heads 50 to a V-diesel engine of the kind shown in FIG. 5 by the general reference 55. This engine has a single cam shaft 56, situated inside the V. Similarly, the inlet manifold assemblies 57 are located inside the V. On the contrary, the exhaust manifolds 58 may be located outside the V, that is to say on each side of the engine.

I claim:

1. In a unit cylinder head for a diesel engine of the type having a single inlet valve seating and a single exhaust valve seating and adapted to receive, respectively, an inlet valve and an exhaust valve, the improvement comprising:

a. a vertical channel formed on each lateral face of the head for forming a joint with an adjacent similar cylinder head, the vertical channel adapted to be aligned with a vertical channel in the adjacent cylinder head to form the joint, each vertical channel having a semi-cylindrical cross-section, b. a clamping screw received in the joint, thereby, straddling the two adjacent cylinder heads, c. two rocker stems to control the valves, one rocker stem for each of the valves, d. a sealing joint disposed at each lateral face and being compressed between two adjacent cylinder heads, and wherein, e. the vertical plane joining the axis of the two valve seatings is inclined in relation to the vertical plane passing through the longitudinal axis of the engine, f. the exhaust manifold is shortened and the inlet manifold is provided with a spiral profile, g. the lateral faces of the head are formed with openings which are used successively for removing the moulding sand during manufacture, and then for the circulation of water from one cylinder head to another, and h. one of the manifolds passes between the two rocker stems to open on to an adjacent face of the cylinder head, while the other manifold opens on to the opposite face of the head.

2. The cylinder head of claim 1 wherein the exhaust manifold passes between the two rocker stems to open on to an adjacent face of the cylinder head, while the inlet manifold opens on to the opposite face of the head.

3. The cylinder head of claim 1 wherein the inlet manifold passes between the two rocker stems to open on to an adjacent face of the cylinder head, while the exhaust manifold opens on to the opposite face of the head.

4. A unit cylinder head according to claim 1 in which there is a provision for the clamping of the cylinder head by eight screws four of which straddle two adjacent cylinder heads.

5. The unit cylinder head of claim 1 wherein the head has a rectangular parallelopiped configuration.

* * * * *